US006921185B2

(12) United States Patent
Monroe et al.

(10) Patent No.: US 6,921,185 B2
(45) Date of Patent: Jul. 26, 2005

(54) WORK LIGHT FRAME WITH SPARE BULB HOLDER

(75) Inventors: Tim Monroe, Fairfield, CA (US); John H. Wandrey, Long Beach, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 49 days.

(21) Appl. No.: 10/650,322

(22) Filed: Aug. 27, 2003

(65) Prior Publication Data

US 2005/0047128 A1 Mar. 3, 2005

(51) Int. Cl.[7] ..... F21V 17/00
(52) U.S. Cl. ..... 362/375; 362/207
(58) Field of Search ..... 362/207, 374–375, 362/269

(56) References Cited

U.S. PATENT DOCUMENTS 3,825,331 A * 7/1974 Procop et al. ..... 352/198
4,110,820 A 8/1978 Konoshima ..... 362/207
4,561,203 A * 12/1985 MacDonald et al. ..... 40/570
5,695,278 A 12/1997 Grossman et al. ..... 362/374
5,845,989 A 12/1998 Leen ..... 362/410
D438,667 S 3/2001 Leen ..... D26/113
6,328,460 B1 * 12/2001 Grossman et al. ..... 362/427
6,450,660 B1 9/2002 Lee ..... 362/207

OTHER PUBLICATIONS

Internet pages, Craftsman 1000 watt Work Light with Tripod, www.sears.com, pp. 1–4, Aug. 8, 2003.

* cited by examiner

*Primary Examiner*—Ali Alavi
(74) *Attorney, Agent, or Firm*—Paul Y. Feng; Fulwider Patton Lee & Utecht, LLP

(57) ABSTRACT

A work light frame for holding a lens to an electric halogen work lamp is disclosed. The work light frame has a front and a back, and preferably has a channel-shape cross-section. A storage compartment for holding a spare bulb is incorporated into the back of the frame and is recessed within the channel-shape cross-section. The storage compartment is covered by a door and has bulb retention structures therein. Preferably, the storage compartment is located at the top of the frame and the frame is hingeably attached to the lamp at the bottom.

20 Claims, 3 Drawing Sheets

WORK LIGHT FRAME WITH SPARE BULB HOLDER

FIELD OF THE INVENTION

This invention relates to work lights, and is more particularly directed to halogen work lights incorporating a spare bulb in the housing.

BACKGROUND OF THE INVENTION

Halogen work lights are widely used in a variety of settings such as construction sites, industrial plants, automotive and auto body repair shops, artist studios, photographic studios, and for home improvement projects. Compared to conventional light bulbs, halogen bulbs have a comparatively high operating temperature which tends to limit the bulb life. Halogen bulbs often burn out while in use on the job or during a project. When a bulb fails, it interrupts the project or job being performed. Usually the interruption stops the job or project until it can be replaced and work can continue. Thus, having a spare bulb in close proximity to the project is very desirable.

In the past, a major disadvantage of using halogen work lights has been the lack of an easily accessible spare halogen bulb. Most often, a burned out bulb requires a trip to the hardware store to find a replacement. Spare bulbs have been stored in vehicles, tool boxes, and other similar places, but these storage locations are often not readily available or accessible. Also, since these storage locations are not specifically tailored to store glass bulbs with delicate filaments inside, damage to the bulb may have taken place by the time the need arises for its use.

At least three configurations of spare bulb housings are known in the prior art. The first configuration stores the halogen bulb in the work light stand or supporting structure. For example, a spare bulb storage housing may be incorporated into a handle of the work light wherein the bulb in stored inside the handle and runs along the length of the handle. The second configuration is a work light with a spare bulb housing that is attached externally to the support. The third configuration has a tubular spare bulb housing that is attached to a crossbar on which a series of work lights are mounted.

All of the preceding spare bulb housing configurations position the spare bulb housing on the exterior of the light itself. Thus, the spare bulb housing being part of the light's exterior, and consequently the spare bulb itself, are prone to jostling, banging, and general abuse during transportation and use of the light in the field.

Further, some of the prior art designs have a spare bulb housing that protrudes from the frame, making the work light unwieldy or making the frame easy to catch on electrical wires or the surrounding environment. Lastly, the location of the spare bulb housing is sometimes inconveniently located for easy access the user.

Therefore, what is needed is a spare bulb holder that is conveniently accessible and is integrated within the work light to prevent the spare bulb from being easily damaged during use and transport. The present invention is designed to fulfill this and other needs.

SUMMARY OF THE INVENTION

The present invention directed to a work light frame, containing within the frame a spare bulb holder. The work light frame has a top, a bottom, a front, a back, and a channel-shape cross-section extending around the perimeter of the frame defining a central open area for a transparent or translucent lens.

The work light frame is preferably attached to the front of a work light that houses an electric halogen or like lamp by a connection means such as, a hinge, a pivot, an axle mechanism or other suitable pivoting device. The frame thus pivots away from the main housing of the electrical lamp to allow access to the burned out bulb.

In one embodiment of the present invention, the spare bulb housing is located in a cavity on the back of the work light frame. The cavity exploits the natural space formed as part of the channel-shape cross-section of the light frame. That is, the spare bulb housing is incorporated within the frame body creating an integrated storage compartment.

The integrated storage compartment is designed to accommodate a tubular-shaped bulb, and is preferably formed by a series of walls, a base and a cover. In one embodiment, the frame of the work light supplies a bowed outer wall for the compartment and the base. The cover is disposed over the cavity formed by the series of walls and is generally parallel to the base.

The cover may be fastened to the compartment by a hinge on one side while the opposite side of the cover may be attached to the one of the walls by a fastener, a plurality of clips, overhanging hooks or snaps, or any combination thereof. In another embodiment, the cover and the wall to which the cover is attached may contain recesses designed to accommodate a fastener. This fastener passes through both the cover and the wall, thus securing the cover over the spare bulb compartment. Alternatively, the fastener may pass through the exterior light frame, the cover and into a wall, thus securing the compartment and the cover to the frame.

The spare bulb is placed within the integrated storage compartment and may be secured by fitting the ends of the bulb into grooves or other means for retaining the bulb. The bulb preferably fits snugly within the grooves, thus minimizing jostling and decreasing the chance of damage when the work light is transported. Alternatively, the means for retaining the bulb may include clips, snaps, adhesives, rubber or plastic pinchers, compression fittings, or the like. Also, a gasket or similar type seal can be applied to the compartment cover and/or integrated into the storage compartment to further add protection for the bulb.

Other aspects, advantages, and novel features of the invention are described below or will be readily apparent to those skilled in the art from the following specifications and drawings of illustrative embodiments.

DETAILED DESCRIPTION OF THE PREFERRED EMBODIMENTS

Figure 1:
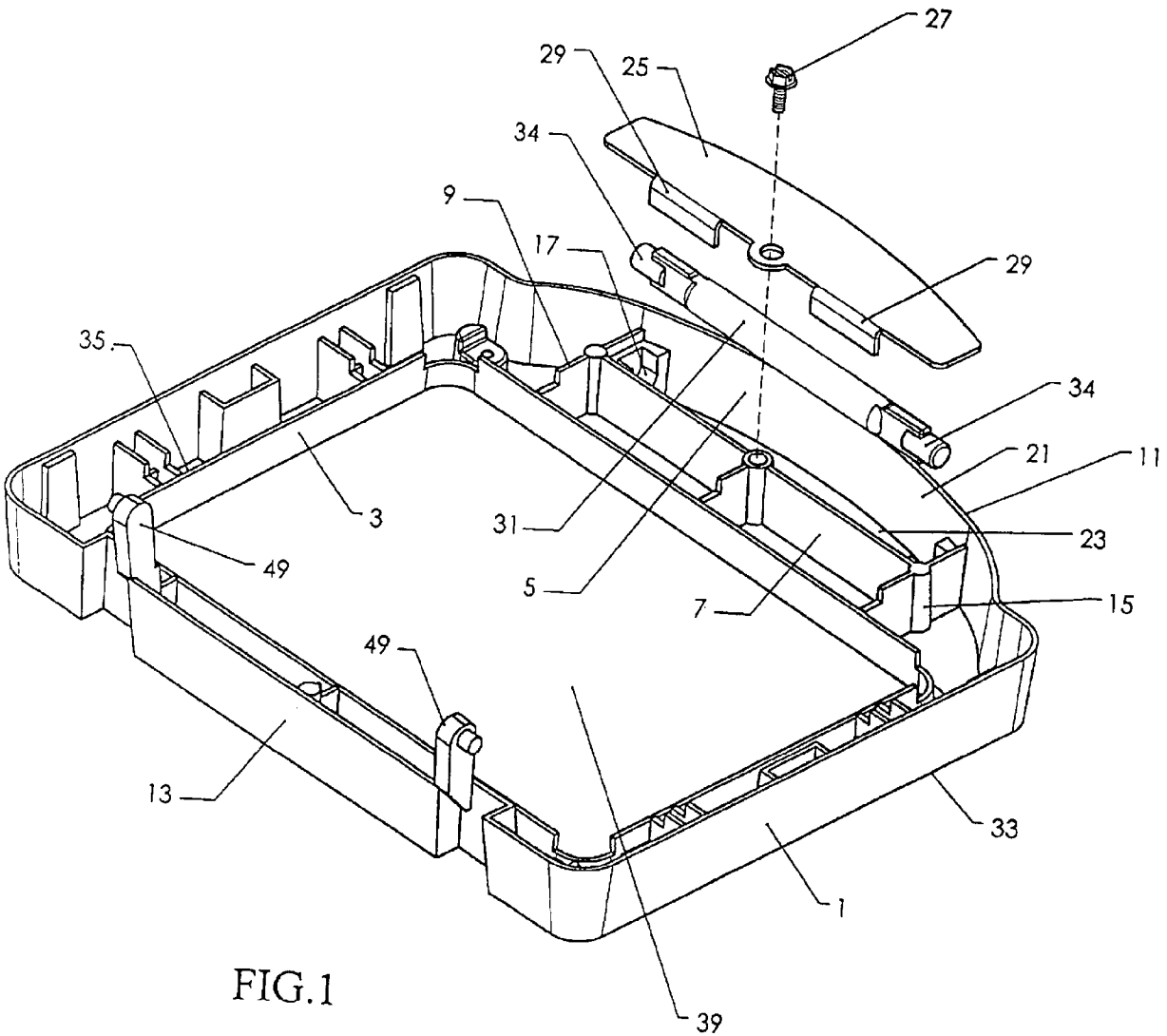
FIG. 1 is a perspective view of the back of a work light frame.

FIG. 1 is a perspective view of the rear or back of a work light frame 1. In this exploded view, the work light frame 1 has a frame body 3 with an integrated storage compartment 5 at the top of the frame body 3. Specifically, the frame body 3 has a frame top 11, a frame bottom 13, a front side 33 and a back side 35 together defining a perimeter of an open area 39 at the center. In this exemplary embodiment, the frame and open area are rectangular, but other shapes and polygons such as a square, circle, triangle, trapezoid, ovoid, etc. are contemplated.

As best seen in FIG. 1, the frame 1 has a cross-section that has a channel or U-shape. The opening of the "U" faces the back side 35, or up in FIG. 1. Preferably, the frame 1 is cast from a metal such as iron or aluminum. It may also be stamped from steel, or formed from a high-temperature resistant polymer or ceramic.

Still in FIG. 1, the integrated storage compartment 5 preferably has a first wall 7, a second wall 9, a third wall 15, a fourth wall 21, a base 23, and a cover 25. The fourth wall 21 and the base 23 coincide with two generally perpendicular surfaces of the channel-shape cross-section. In other words, the walls are formed generally perpendicularly to the back side 35 of the frame body 3, except for the fourth wall 21 which is part of the frame top 11. Similarly the back side 35 supplies the integrated compartment with the base 23. The fourth wall 21 may be bowed outward as shown to make extra room in the compartment 5 for better finger access. Indeed, any or all of the walls may be bowed outward to increase storage space, or they may be concaved to reduce bulk in the frame.

To accommodate the compartment 5, the frame 1 shown in FIG. 1 preferably has a wider channel-shape cross-section at the frame top 11 as compared to the rest of the frame 1. Alternative embodiment frames may have a channel-shape cross-section wide enough to accept the compartment 5 that no such accommodation is necessary and the frame has a more uniform cross-section around its perimeter. Moreover, the channel-shape cross-section may be omitted altogether for the frame in other embodiments. Insofar as a spare bulb compartment or housing is formed in the back side of the frame similar to that shown in FIG. 1, no channel-shape cross-section in the frame is necessary.

The second wall 9 and the third wall 15 each has an optional indentation, slot, or groove 17 which is used to retain the ends of a spare bulb 31. The spare bulb 31 in this application is an incandescent halogen type that has a long, tubular glass center section with plastic or ceramic insulators and conductor leads at the two ends 34. Accordingly, the two ends 34 slide into the opposed grooves 17 inside the compartment 5. The spare bulb 31 preferably fits snugly within the grooves 17, thus minimizing jostling and decreasing the chance of damage when the work light is transported.

Alternatively, the means for retaining the bulb may include clips, snaps, adhesives, hooks, rubber or plastic pinchers, compression fittings, or the like. Of course, the means for retaining the bulb can be designed to hold more than one bulb. The interior of the compartment 5 may be lined with felt, rubber, plastic, Styrofoam, or similar soft material to further protect the spare bulb 31 from shock. In other alternative embodiments, the cover and/or the compartment is lined with a gasket or seal to further protect the bulb.

Clips 29 formed into the cover 25 may be used to hook onto the first wall 7. The cover 25 may be hinged at the bottom or hinged at the top. Alternatively, as seen in FIG. 1, the clips 29 center the cover 25 over the compartment 5 by bracing against the first wall 7. A fastener 27 such as a screw is then used to secure the cover 25 to the frame body 3 by passing through the cover 25 and threading into the first wall 7. When closed, the cover 25 sits flush along or even beneath a theoretical plane defined by the back side 35 of the frame 1. This ensures that the presence of the spare bulb compartment 5 does not interfere with the fitment of the frame 1 to the work light housing.

In alternative embodiments, the cover can snap into place by means of protrusions, nubs, or a clip extending from the frame. A wire, cable, chain, or the like optionally joins the cover to the frame to prevent the cover from detaching or being misplaced.

Figure 2:
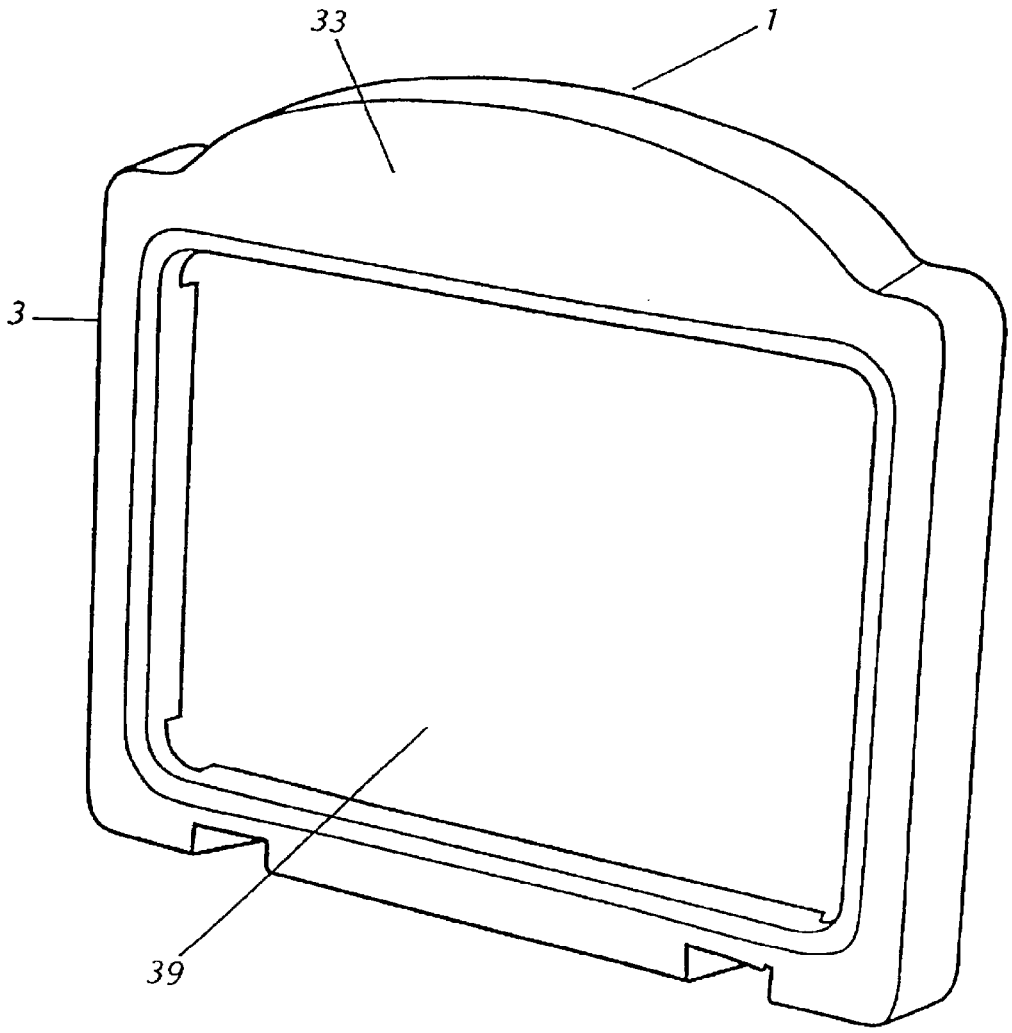
FIG. 2 is a perspective view of the front of the work light frame.

FIG. 2 is a perspective view of the front of the work light frame 1. The frame 1 has an enclosed perimeter shape making up the frame body 3, the front side 33, and defining a central opening 39. Clearly, the present invention contemplates different shapes for the frame body 3 and the central opening 39 aside from the rectangular one shown. As indicated in this view, the integrated storage compartment 5 is hidden from view, does not protrude or intrude into the uncluttered overall form of the frame 1, and sits behind the facade of the front side 33 of the frame body 3.

Figure 3:
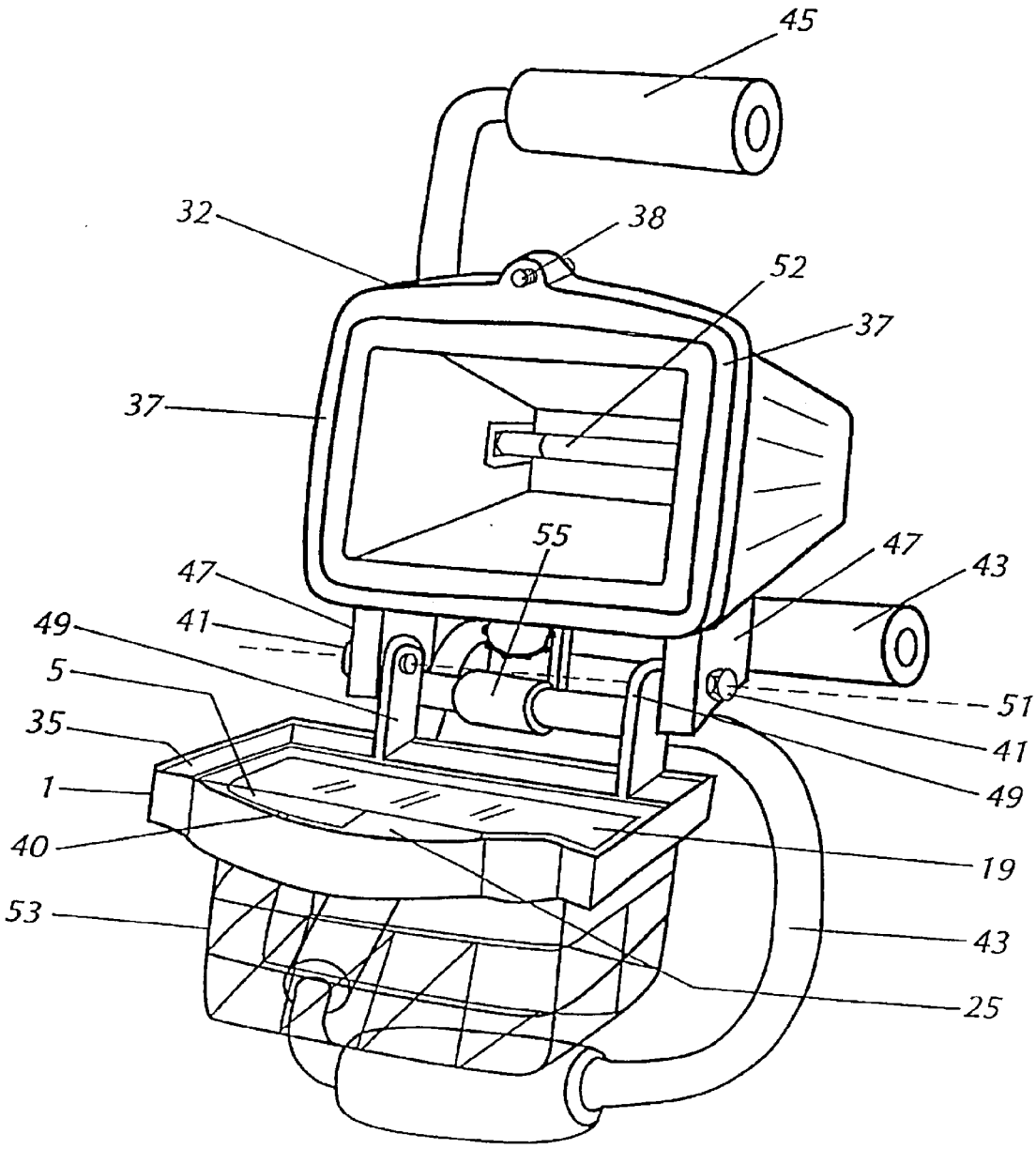
FIG. 3 is a perspective view of the front view of the work light frame as attached to a work light.

FIG. 3 is a perspective view of the present invention work light frame 1 connected to a lamp housing 32, where the frame 1 is shown in the swung-open position. This opens access to the interior of the lamp housing 32 where the user can reach the burned-out bulb 52. In this exemplary embodiment, the lamp housing 32 is attached via a clamp 55 to an optional stand 43. The stand 43 is formed from tubing that is bent into a three-dimensional platform to support the housing 37 and to act as a carry handle 45. The clamp 55 enables the lamp housing 32 to be repositioned at different angles and locations around the tubing.

The work light frame 1 is joined to the lamp housing 32 preferably at the bottom thereof by a rotatable means 41. In this embodiment, the rotatable means 41 refers to tabs 47 extending from the underside of the housing 37 that meet with tabs 49 extending toward the rear of frame 1. Interconnecting the tabs 47, 49 is a stud, bolt, rivet, pin, screw, or the like. Together the structures permit the frame 1 to pivot open and closed. Of course, other rotatable means are contemplated, including tabs with pivot pins that snap into receiving tabs with divots or grooves therein.

The work light frame 1 pivots open or closed around axis 51 (dashed line). Swinging open the frame 1 as shown in FIG. 3 allows simultaneous access to both the burned-out bulb 52 and the integrated storage compartment 5 containing the spare bulb. Hence, one benefit of having the integrated storage compartment 5 on the back side 35 of the work light frame 1 becomes clear.

The frame 1 circumscribes a transparent or translucent lens 19 made of plastic or glass. To protect the lens 19, the frame may optionally include a wire grille 53.

As seen in FIG. 3, the cover 25 overlying the spare bulb compartment 5 is closed. It is possible to omit the cover 25, because when the frame 1 is swung-closed against the lamp housing 32, the area previously occupied by the cover 25 abuts against the lip 37 of the lamp housing 32. The lip 37 thus serves to enclose and hold the spare bulb 31 in place without the cover 25. When the frame 1 is closed against the lip 37, the structures may be clamped, hooked, friction fit, snapped, or screwed together. In the embodiment shown in FIG. 3, a screw 38 passes through the lip 37 into the back side 35 of frame 1 and advances into a threaded hole 40. As such, the frame 1 is tightly secured against the lip 37 while also pressing the lens 19 against the lamp housing 32.

The present invention therefore benefits from having the spare bulb compartment 5 conveniently located in the back of the frame 1. So as the user swings the frame 1 away from the housing 32 to access the burned-out bulb 52, the compartment 5 containing the spare bulb 31 is at his or her fingertips. The location of the compartment 5 at the top 11 of the frame 1 is advantageous since this is the farthest point away from the burned-out but still hot bulb, and the extra room in this area gives the user more space for glove-covered finger manipulation of the spare bulb. The user also does not need to reach under or around the housing 32 to access a spare bulb held in those areas, which housing 32 after typical use may be very hot and may burn the user's forearm or hand. Lastly, the compartment 5 is incorporated into the overall form of the frame 1 so that the frame 1 and housing 32 together have a sleek silhouette; there are no unwieldy protrusions to catch on wires or block light emission through the lens 19.

It is of course contemplated to locate the spare bulb compartment at other locations around the frame 1. Furthermore, the spare bulb compartment may contain more than one bulb of various shapes and sizes of the halogen type, neon, or normal incandescent.

While the present invention has been described with reference to halogen work lights, it will be appreciated by those skilled in the art that numerous variations, modifications, and alternative applications are possible. Accordingly, such variations, modifications, and alternative applications should be regarded as being within the spirit and scope of the invention as defined by the appended claims.

What is claimed is:

1. A work light frame for holding a lens on to a lamp housing, comprising:

a frame body having a frame body top and a frame body bottom, a front side and a back side, together defining a perimeter of an open area at the center;

the frame body top containing an integrated storage compartment;

the integrated storage compartment having a first wall that is opaque to light and disposed between the interior of the integrated storage compartment and the open area at the center of the frame;

the first wall connecting a second wall to a third wall;

a fourth wall connecting the second wall to the third wall;

a base joining the first, second, third, and fourth walls; and a cover disposed over the compartment.

2. The work light frame according to claim 1, wherein the cover is flush with a back side of the frame.

3. The work light frame according to claim 1, wherein the cover is attached to the first wall by a fastener.

4. The work light frame according to claim 1, wherein the storage compartment is located at the frame body top.

5. A work light frame for holding a lens on to a lamp housing, comprising:

a frame body having a frame body top and a frame body bottom, the frame body top containing an integrated storage compartment;

the integrated storage compartment having a first wall connecting a second wall to a third wall;

a fourth wall connecting the second wall to the third wall;

a base joining the first, second, third, and fourth walls; and a cover disposed over the compartment, wherein the second wall and the third wall contain grooves for securing a light bulb.

6. A work light frame for holding a lens on to a lamp housing, comprising:

a frame body having a frame body top and a frame body bottom, the frame body top containing an integrated storage compartment;

the integrated storage compartment having a first wall connecting a second wall to a third wall;

a fourth wall connecting the second wall to the third wall;

a base joining the first, second, third, and fourth walls; and a cover disposed over the compartment, wherein the second wall and the third wall include a means for securing a light bulb.

7. The work light frame according to claim 1, wherein one of the walls is bowed.

8. The work light frame according to claim 1, wherein the fourth wall is provided by the frame body top.

9. The work light frame according to claim 1, wherein the base is provided by the frame body.

10. A work light frame for holding a lens on to an electric lamp housing, comprising:

a frame having a channel-shape cross-section extending around a perimeter defining a central opening;

a lens disposed within the central opening;

a means for rotatably attaching the frame to the front of the electric lamp housing;

a cavity formed within the frame; and a means for retaining a bulb disposed within the cavity.

11. A work light frame according to claim 10, wherein a wall forming part of the cavity is bowed.

12. A work light frame according to claim 10, wherein the means for retaining the bulb includes opposed grooves that receive opposite ends of the bulb.

13. A work light frame according to claim 10, wherein the cavity is partially formed from the channel-shape cross-section.

14. A work light frame according to claim 10, wherein the channel-shape cross-section is wider at a location diametrically opposite from the means for rotatably attaching.

15. A work light frame according to claim 10, wherein the channel-shape cross-section is greater at the cavity.

16. A process for providing a work light frame for holding a lens onto an electric lamp housing, comprising:

providing a frame having a channel-shape cross-section extending around a perimeter defining a central opening;

disposing a lens within the central opening;

forming a cavity within the frame;

providing a means for retaining the frame to the front of the electric lamp housing;

providing a means for retaining a bulb disposed within the cavity; and providing a door hinged to the cavity.

17. The process of claim 16, wherein the frame is cast from a metal.

18. The process of claim 16, wherein the cavity is cast into the frame.

19. The process of claim 16, wherein the channel-shape cross-section is wider at the cavity than elsewhere in the frame.

20. The process of claim 16, wherein the cavity has an elongated shape and is recessed into the channel-shape cross-section.

* * * * *